United States Patent [19]

Shawke

[11] 4,251,955

[45] Feb. 24, 1981

[54] HUB ASSEMBLY

[75] Inventor: Jerome R. Shawke, Boston Heights, Ohio

[73] Assignee: The Warner & Swasey Company, Cleveland, Ohio

[21] Appl. No.: 7,658

[22] Filed: Jan. 29, 1979

[51] Int. Cl.[3] ..... B24B 41/00

[52] U.S. Cl. ..... 51/168

[58] Field of Search ..... 51/168

[56] References Cited

U.S. PATENT DOCUMENTS

| | | | |
|---|---|---|---|
| 922,049 | 5/1909 | Sanfason | 51/168 |
| 1,193,525 | 8/1916 | Dosch | 51/168 |
| 2,616,230 | 11/1952 | Hough | 51/168 |
| 2,747,343 | 5/1956 | Gellert | 51/168 |
| 3,728,827 | 4/1973 | Koppenwallner | 51/168 |
| 3,967,415 | 7/1976 | Seckinger et al. | 51/168 |

FOREIGN PATENT DOCUMENTS

| | | | |
|---|---|---|---|
| 1137066 | 1/1957 | France | 51/168 |

*Primary Examiner*—Othell M. Simpson
*Assistant Examiner*—Roscoe V. Parker

[57] ABSTRACT

A hub assembly 30 for releasably mounting a circular grinding wheel 18 on a rotatable shaft 14 is disclosed. The assembly 30 includes a hub 36 having a radially extending face 42 to engage one major side surface of the grinding wheel. A central axially extending surface 122 on the hub engages a central passage 120 through the grinding wheel 18 to center the grinding wheel relative to the hub. An annular flange or clamp member 40 has an opposing radially extending face 44 which clamps the grinding wheel against the hub. The flange is centered relative to the hub by an axially extending surface 132 which engages the central passage through the grinding wheel. The flange includes a plurality of slots 70–84 through which the screws 50–64 extend. The heads of the screws may pass through wide portion 90 of the slots, but they cannot pass through narrow portions 96. The flange may be rotated between a disengaged position and an engaged position. In the disengaged position, the heads of the screws are aligned with the wide portions of the slots to enable the flange to be removed. In the engaged position, the heads of the screws are aligned with the narrow portions of the slots to permit the flange to be clamped against the grinding wheel. A cover plate 150 covers the outside of the slots. Holes are formed in the plate to provide access to the screws.

19 Claims, 5 Drawing Figures

HUB ASSEMBLY

BACKGROUND OF THE INVENTION

The present invention relates to grinding machines and in particular to a grinding wheel mounting assembly.

In grinding machines, such as crankshaft grinders and camshaft grinders, a grinding wheel is rotated and brought into contact with the workpiece to perform a grinding operation. In time the grinding wheel may become worn and replacement is necessary. Because the time required to replace the grinding wheel results in lost production, attempts have been made to provide a grinding wheel mounting assembly which is quickly and easily released.

Two known grinding wheel mounting arrangments are disclosed in U.S. Pat. Nos. 922,049 and 1,193,525.

SUMMARY OF THE PRESENT INVENTION

The grinding wheel mounting arrangement of the present invention includes a hub which is fixedly connected with a rotatable drive shaft. A grinding wheel is positioned in a coaxial relationship with the shaft by engagement of an axially extending surface on the hub with a central passage in the grinding wheel. A radially extending face surface on the hub engages one of the major sides of the grinding wheel to locate the grinding wheel axially relative to the hub.

The grinding wheel is pressed against the hub by a flange or clamp member. The flange is positioned in a coaxial relationship with the grinding wheel and hub by engagement of an axially extending surface on the hub with a central passage in the grinding wheel. A radially extending face surface on the flange is pressed against a major side surface of the grinding wheel by screws which extend beteen the flange and the hub. When the screws are tightened, the grinding wheel is firmly clamped between the flange and the hub in such a manner as to hold the grinding wheel against axial and radial movement relative to the drive shaft.

The shank portions of the screws pass through slots in the flange and extend into threaded engagement with the hub. Each of the slots through which the shank portions of the scews pass has a narrow end through which the head of a screw cannot pass and a wide end through which a head of the screw can pass. There is a recess in the narrow end of each slot into which the heads of the screws seat a small distance.

The flange is easily disengaged from the hub. Once the screws have been loosened and unscrewed the seated distance, the flange may be rotated relative to the hub and grinding wheel to bring the heads of the screws into alignment with the wide ends of the slots. Then the flange may be moved axially away from the hub, releasing the grinding wheel.

The screws are located so that they need not be removed completely to change the grinding wheel. The screws extend axially from the hub at a radial location which is inward of the central passage through the grinding wheel. The screws are located sufficiently inward of the central passage through the grinding wheel that the head portions of the screws clear the passage as the grinding wheel is moved axially onto or off of the hub.

To prevent the grinding wheel from being crushed or cracked between the gripping faces on the hub and flange, the hub and the flange have stop surfaces which cooperate to limit the extent of axial motion of the flange toward the hub. The stop surfaces are axially offset from the gripping faces on the hub and flange. The total offset is such that when the two stop surfaces are drawn into abutting engagement by tightening the screws, the distance between the two gripping faces is equal to or only slightly less than the thickness of the grinding wheel.

The hub assembly includes a cover which provides an important safety feature and also keeps dirt and grit from getting into the slots in the flange. The cover is an annular plate mounted on the flange and extends across the outside of the slots. There are a plurality of circular holes in the cover. Each hole is positioned above the recess in the narrow end of a slot so that a tool may be inserted through the cover to loosen or tighten the screws only when the screws are properly aligned with the recesses.

Accordingly, it is an object of the present invention to provide a new and improved assembly for connecting a grinding wheel with a rotatable drive shaft wherein the grinding wheel is clamped between a hub and a flange, the flange being held in engagement with the hub by a plurality of screws and being easily releasable from the hub.

It is a further object of the present invention to provide a new and improved assembly as set forth in the preceeding object and wherein the heads of the screws are accessible through openings in a cover plate on the flange only when they are properly aligned with the flange.

It is a further object of the present invention to provide a new and improved assembly as set forth in the preceding object in which the cover plate is integrally formed with the flange.

Another object of this invention is to provide a new and improved assembly for connecting a grinding wheel with to a rotatable drive shaft and wherein the grinding wheel is positioned in a coaxial relationship with a hub by engagement of an axially extending surface of the hub with a central passage in the grinding wheel and wherein a clamp member is positioned in a coaxial relationship with the grinding wheel by engagement of an axially extending surface on the clamp member with the central passage in the grinding wheel.

BRIEF DESCRIPTION OF THE DRAWINGS

These and other objects and features of the present invention will become more apparent upon a reading of the following description of a preferred embodiment of the invention taken together with the accompanying drawings in which.

DESCRIPTION OF ONE PREFERRED EMBODIMENT

Figure 1:
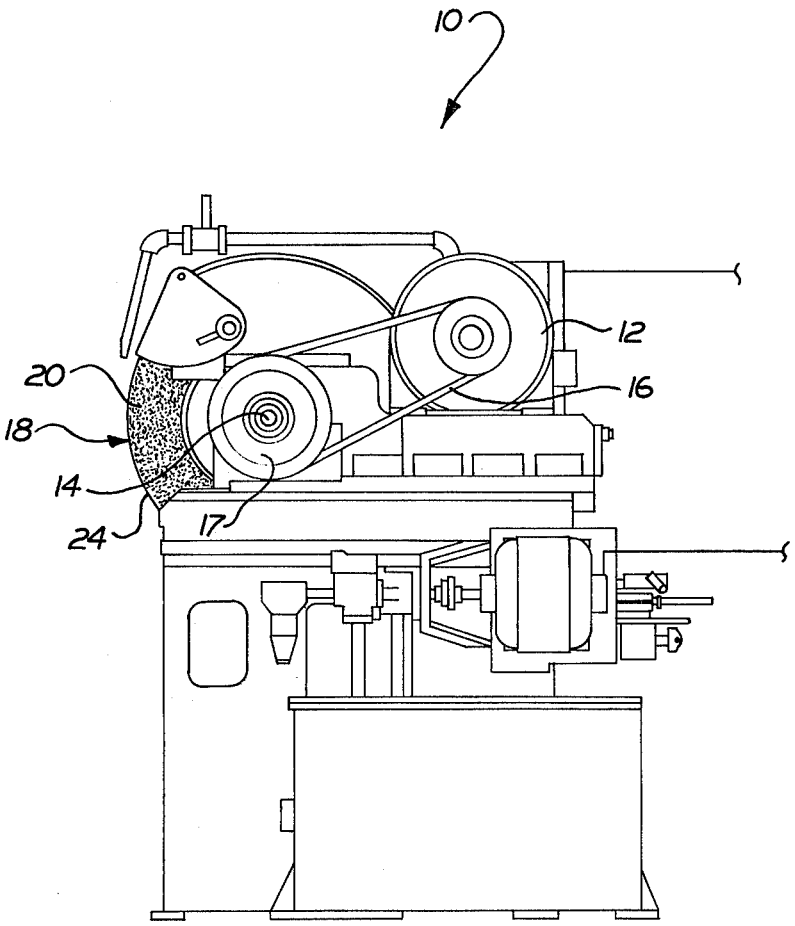
FIG. 1 is an illustration of a grinding machine equipped with a hub assembly costructed in accordance with the present invention.

A grinding machine 10 (FIG. 1) has a hub assembly 30 (FIG. 2) constructed in accordance with the present invention. A motor 12 (FIG. 1) is connected to a rotatable shaft 14 through a drive belt 16 and pulley 17. The hub assembly 30 (FIG. 2) connects a generally circular grinding wheel 18 with the shaft 14.

A grindiing machine such as the grinding 10 (FIG.1) may be used in numerous industrial applications, such as grinding crankshafts and camshafts. The grinding wheel 18 is generally circular having two parallel annualar major side surfaces 20 and 22 (FIG. 2) and a cylindrical edge surface 24 (FIG. 1). After a period of operation, the diameter of the grinding wheel 18 may become reduced to the point where the grinding wheel is no longer suitable for use. When this occurs, the grinding wheel must be replaced. The hub assembly 30 of the present invention minimizes the amount of time required to replace the grinding wheel 18, and thus minimizes the downtime of the grinding machine 10 (FIG. 1).

The hub assembly 30 (FIG. 2) is connected with the rotatable shaft 14 for rotation together with the shaft. A tapering end portion 32 of the shaft 14 engages a corresponding tapering passage 34 through a one-piece hub 36. A nut 38 threadably engages one end portion of the rotatable shaft 14 and forces the tapering passage 34 of the hub 36 into tight engagement with the tapering end portion 32 of the shaft 14.

An annular flange or clamp member 40 is releasably connected with hub 36 and cooperates with the hub to grip the grinding wheel 18. A radially extending annular gripping face 42 on the hub 36 engages one major side surface 20 of the grinding wheel 18. A corresponding, radially extending annular gripping face 44 of the flange 40 engages the opposite major side surface 22 of the grinding wheel 18.

The grinding wheel 18 is clamped between the face surface 42 on the hub 36 and the face surface 44 on the flange 40 by a circular array screws. Eight cap screws 50, 52, 54, 56, 58, 60, 62, and 64 (FIG. 3), or other suitable threaded fasteners, extend through eight keyhole slots 70, 72, 74, 76, 78, 80, 82, and 84 formed in the flange 40. The screws 50–64 have head end portions 92 (FIG. 2) which are received in the slots 70–84 and threaded end portions 102 which are received in the hub 36 to hold the hub and flange together.

To effect a quick release of the grinding wheel 18 it is necessary to loosen the screws 50–64 one or more turns. The flange 40 is then rotated until the heads 92 of the screws 50–64 are aligned with the wide portions 90 (FIG. 4) of the arcurate keyhole slots 70–84. The outside surface 86 (FIG. 2) of the flange 40 is knurled to facilitate manual rotation of the flange to bring the heads 92 of the screws 50–64 (FIG. 3) into alignment with the wide portions 90 of the slots 70–84. The flange 40 may then be moved axially away from the hub 36 to release the grinding wheel 18.

The slots 70–84 provide a guide path for the screws 50–64 to facilitate removing the flange 40. The slots 70–84 are identical and symetrically disposed in a circular array about the central axis of the flange 40 (see FIG. 3). Therefore only one slot 70 will be fully described. However, it is to be understood that this description applies equally well to the remaining slots 72, 74, 76, 78, 80, 82, and 84.

Figure 4:
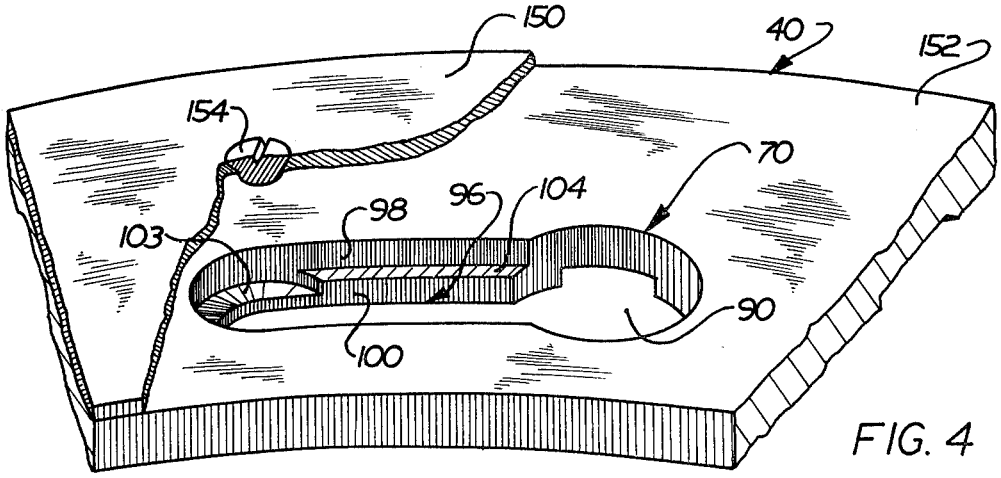
FIG. 4 is a partially broken-away perspective view of one of the slots of FIG. 3.

An enlarged perspective view of the slot 70 is shown in FIG. 4. The slot 70 has a generally keyhole shaped configuration. A circular head end portion 90 of the slot 70 has a relatively large diameter. The diameter of the wide portion 90 is large enough to permit the head 92 (FIG. 2) of the screw 50 to pass easily through the wide portion. As shown in FIG. 4 the wide portion 90 of the slot 70 intersects an annular recess 131 in the flange. This however need not be so. The slots 70–84 may be located radially inward from the annular recess 131 so that the slots do not intersect the recess.

An arcuately extending narrow end portion 96 (FIG. 4) of the slot 70 has a center of curvature which is coincident with the central axis of the circular flange 40. The slot 70 can be considered as divided axially by a radially extending shoulder 104. The slot 70 includes an axially outer portion 98 and an axially inner portion 100, as viewed in FIGS. 2 and 4. The outer portion 98 of the slot 70 is narrower than the circular head end portion 90 of the slot, but is still wide enough to receive the head 92 (FIG. 2) of the screw 50. The inner portion 100 of the slot 70 is narrower than the outer portion 98 so that only the shank portion 102 of the screw 50 will pass through the axially inner portion 100.

At the end of the slot 70 opposite from the head end 90 is a recess or seat 103 formed in a radially extending shoulder 104. As viewed in FIG. 2, the head 92 of the screw 50 seats in the recess or seat 103. When the screw 50 is tightened, it bears against the seat 103 and clamps the flange 40 against the grinding wheel 18 to thereby press the grinding wheel against the hub 36.

When installing a replacement grinding wheel 18 on the grinding machine 10 (FIG. 1), the wheel is installed on the hub 36 (FIG. 2) in a coaxial relationship with the drive shaft 14 and hub. To this end, a surface of a central cylindrical passage 120 through the grinding wheel 18 is disposed in abutting engagement with an axially extending cylindrical surface 122 on the hub 36. The cylindrical surface 122 is parallel to and coaxial with the longitudinal axis of the rotatable shaft 14. Thus the cylindrical surface 122 on the hub 36 serves to keep the center of the wheel 18 aligned with the center of the rotatable shaft 14.

It should be noted that the cap screws 50–64 (FIG. 3) are located radially inward of the cylindrical surface 122 on the hub 36. The screws 50–64 are located so that the heads 92, clear the passage 120 through the wheel as the wheel is put onto or removed from the hub 36. This enables the grinding wheel 18 to be installed and removed while the screws 50–64 remain in threaded engagement with the hub 36.

The hub 36 has an annular gripping face 42 which engages a major side surface 20 of the grinding wheel 18. The gripping surface 42 is separated from the cylindrical surface 122 by an annular recess 130. The recess 130 is provided to enable the hub 36 to grip the wheel 18 only at a location spaced from the central passage 120 through the wheel. This minimizes any tendency to break the grinding wheel 18 by gripping too close to the edge of the grinding wheel. A similar annular recess 131 is provided in the flange 40. The recess 131 separates the gripping face 44 on the flange 40 from the central cylindrical surface 132 to minimize any tendency to break the grinding wheel 18 caused by gripping too close to the edge of the grinding wheel.

Once the wheel 18 has been installed on the hub 36, the flange 40 is installed. To install the flange 40, it is oriented with the wide portions 90 (FIG. 4) of slots 70–84, aligned with the heads 92 of the screws 50–64. When the flange 40 is properly aligned, it is moved axially over the screws 50–64 until the gripping surface 44 (FIG. 2) on the flange 40 engages the annular side 22 on the grinding wheel 18.

At this time, a cylindrical axially extending surface 132 on the flange 40 engages an axially outer portion of the cylindrical central passage 120 through the grinding wheel 18. The cylindrical flange surface 132 has the same diameter and is located in a coaxial relationship with the cylindrical surface 122 on the hub. This assures that the flange 40 will be coaxial with the hub 36 and the grinding wheel 18.

To secure the grinding wheel 18 to the hub assembly 30, the flange 40 is then rotated to bring the shoulder 104 of the slots 70–84 into contact with the heads of the screws 50–64. The flange is rotated in a clockwise direction, as viewed in FIG. 4, relative to the screws 50–64 until the screws are aligned with the seats 103 in the slots 70–84. The screws 50–64 are then turned down into the seats 103 and tightened to prevent the flange 40 from rotating and to draw the flange 40 against the wheel 18. As this occurs, the gripping face 44 engages a portion of the major side surface 22 of the wheel 18 to clamp the wheel against the gripping face 42 on the hub 36.

The gripping face 44 on the flange 40 is at the same radial location as the gripping face 42 on the hub 36. When the screws 52–64 are tightened, the gripping faces 42 and 44 are on opposite sides of the grinding wheel 18 and are radially aligned with each other to securely hold the grinding wheel against axial movement. The cylindrical hub surface 120 and flange surface 132 hold the grinding wheel against radial movement.

The hub assembly 30 is provided with a pair of opposing stop surfaces 140 and 142 which limit the extent of axial motion of the flange 40 toward the hub 36 when the screws 50–64 are tightened. The radially extending annular stop surface 142 on the flange 40 is axially offset from the gripping face 44 in the direction of the annular major side surface 20 of the grinding wheel 18. A corresponding annular surface 140 on the hub 36 is also axially spaced from the gripping face 42 on the hub in the direction of the opposite annular major side surface 22 of the grinding wheel 18.

As the cap screws 50–64 are drawn tight, the stop surfaces 140 and 142 come into abutting engagement. When this occurs, the gripping faces 42 and 44 on the hub 36 and flange 40 are spaced apart by an amount slightly less than the axial thickness of the wheel 18. In this way the stop surfaces 140 and 142 limit the clamping force on the grinding wheel 18 and prevent damage which might occur if an excessive clamping force were applied.

Figure 2:
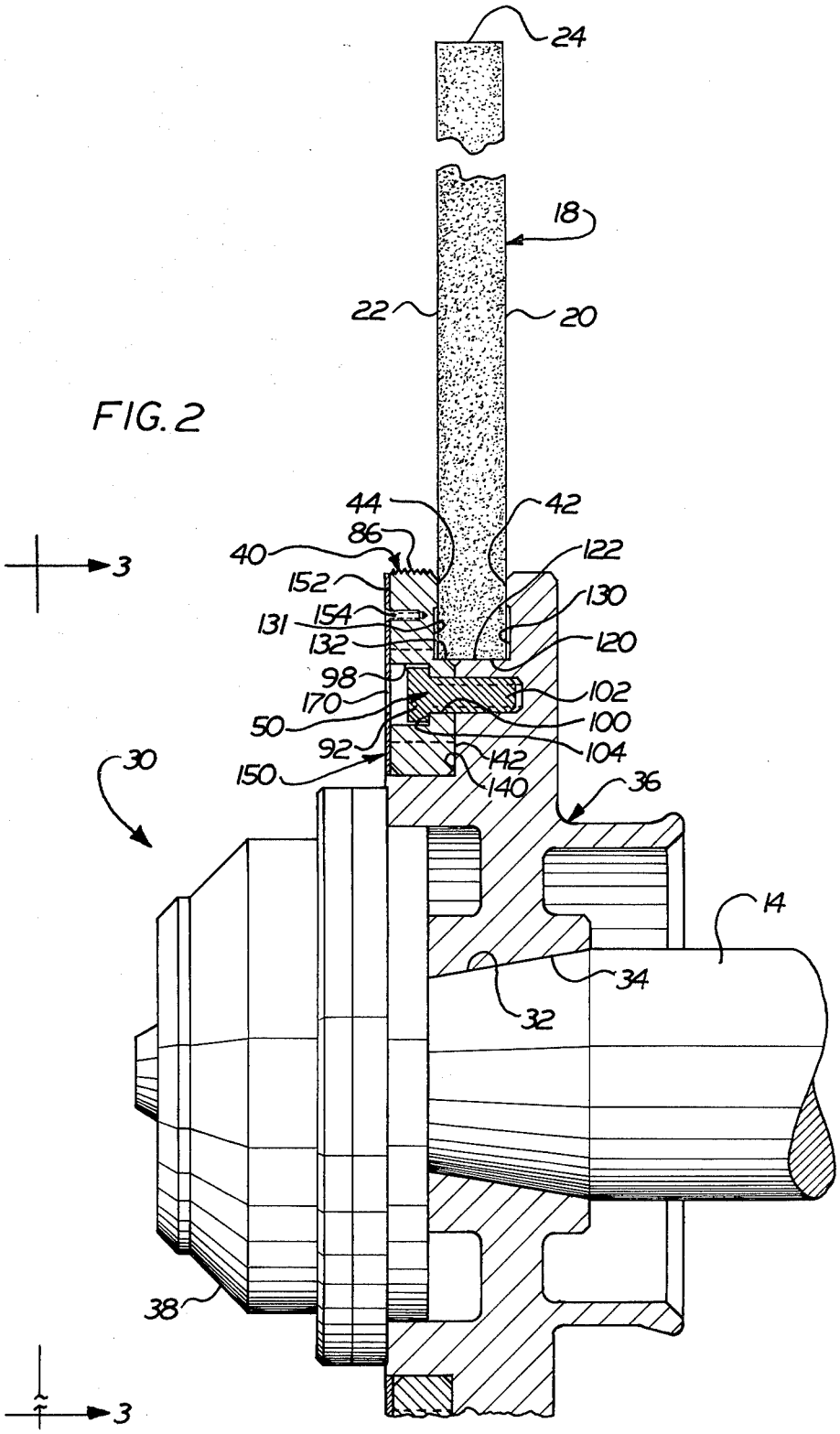
FIG. 2 is a partially broken-away sectional view of a portion of the grinding machine of FIG. 1 showing a rotatable drive shaft, the hub assembly, and a grinding wheel.
Figure 3:
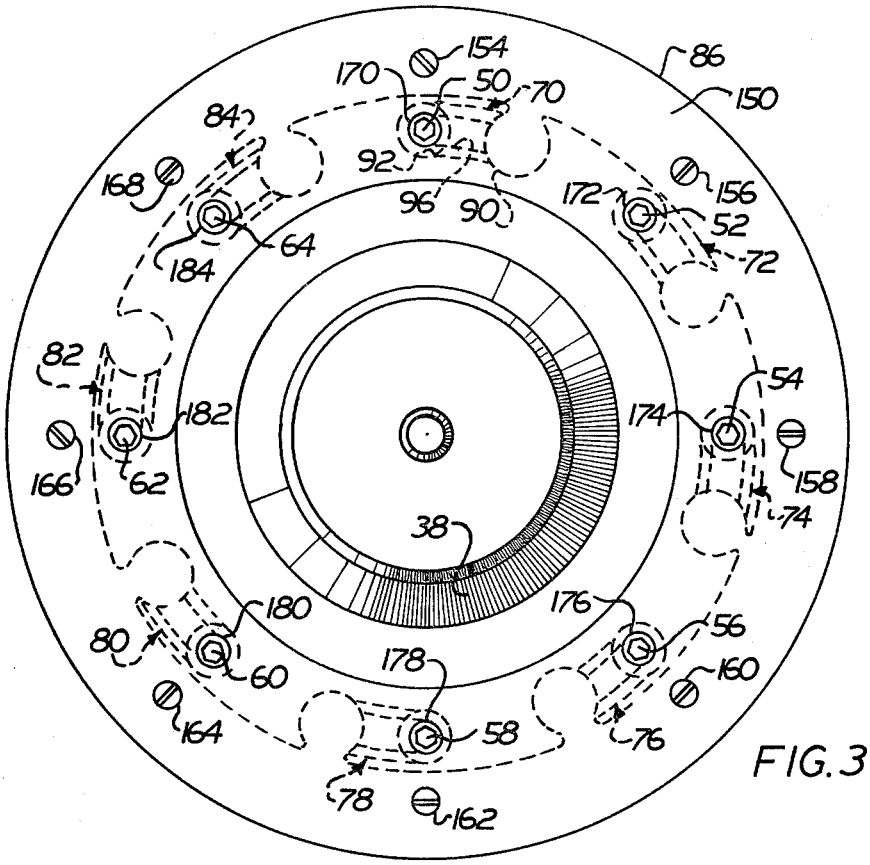
FIG. 3 is a view taken generally along line 3—3 of the hub assembly and illustrating a cover plate which extends across screw slots in a flange or clamp member.
Figure 5:
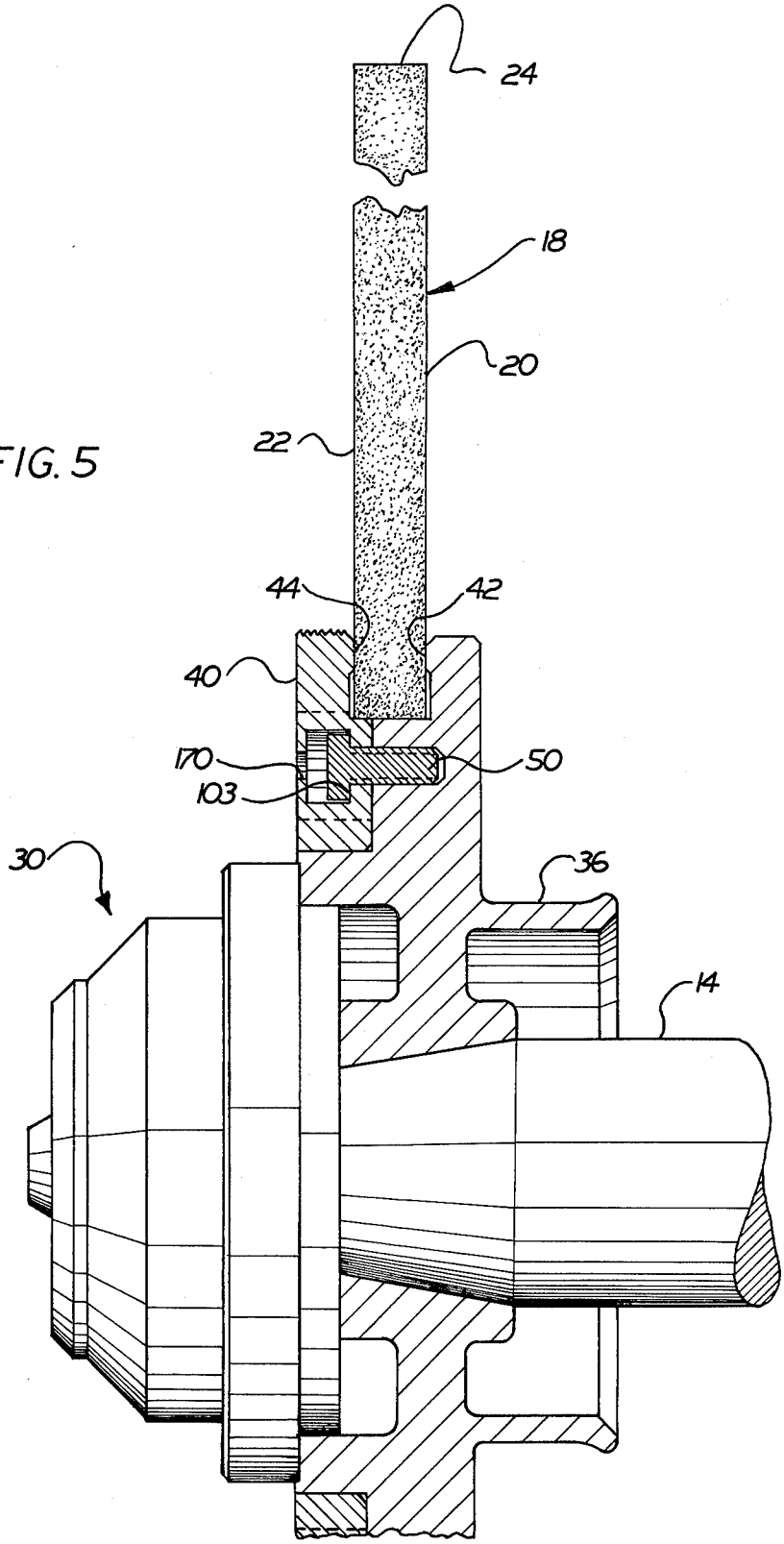
FIG. 5 is a sectional view generally similar to FIG. 2 but showing a flange and cover plate which are formed from a single piece of material.

The flange or clamp member 40 is provided with a cover plate 150. The cover 150 is an annular plate which keeps dirt and particles produced in the grinding operation out of the slots 70–84. The annular cover plate 150 is held in abutting engagement with the annular outside surface 152 of the flange 40 by a plurality of flat head screws 154, 156, 158, 160, 162, 164, 166, and 168 (FIG. 2). In the embodiment shown in FIGS. 2–4 the cover plate 150 is made removable in order to facilitate cleaning the slots 70–84. However, the cover plate may also be integrally formed with the flange 40 as shown in FIG. 5 in which similar numerals have been used to indicate similar parts.

The cover plate 150 is also provided with eight circular passages 170, 172, 174, 176, 178, 180, 182, and 184 which are aligned over the narrow end portion 96 (FIG. 4) of the slots 70 through 84. The circular passages 170–184 ar provided to permit a tool, such as allen wrench or a socket wrench, to be inserted through them to tighten or loosen the screws 50–64. Thus, the cover plate provides an important safety mechanism in that the screws 50–64 can be tightened only when they are properly aligned with the recesses 103 (FIG. 4) because it is only then that the passages 170–184 and screw heads 92 are aligned to permit a tool to engage the screw heads.

To remove a worn grinding wheel, a suitable tool is extended through the hole 170–184 and the screws 50–64 are loosened. The flange 40 is then rotated, counterclockwise as viewed in FIG. 3, until the heads, 92 of the cap screws 50–64 are aligned with the wide portions 90 of the slots 70–84. The flange may then be moved axially away from the hub 36 and the wheel 18 removed.

Thus it is clear that the hub assembly 30 (FIG. 2) of the present invention includes a hub 36 which is fixedly connected with a rotatable drive shaft 14. The grinding wheel 18 is positioned in a coaxial relationship with the shaft 14 by engagement of an axially extending surface 122 on the hub 36 with a central passage 120 in the grinding wheel. A radially extending face surface 42 on the hub 36 engages a major side 20 of the grinding wheel 18 to locate the grinding wheel axially relative to the hub.

The grinding wheel 18 is pressed against the hub 36 by a flange or clamp member 40. The flange 40 is positioned in a coaxial relationship with the grinding wheel 18 and hub 36 by engagement of an axially extending surface 132 on the flange with the central passage 120 on the grinding wheel. A radially extending face surface 44 on the flange 40 is pressed against the opposite major side surface 22 of the grinding wheel 18 by screws 50–64 (FIG. 3) which extend between the flange and the hub 36. When the screws 50–64 are tightened, the grinding wheel 18 is firmly clamped between the flange 40 and the hub 36 in such a manner as to hold the grinding wheel against axial and radial movement relative to the drive shaft 14.

The flange 40 is easily disengaged from the hub 36. The shank portions 102 (FIG. 2) of the screws 50–64 pass through slots 70–84 (FIG. 3) in the flange to threadably engage the hub 36. Each of the slots 70–84 through which the shank portions 102 of the screws pass has a narrow end 96 (FIG. 4) through which a head of the screw can pass. Once the screws 50–64 have been loosened, the flange 40 may be rotated relative to the hub 36 and grinding wheel 18 to bring the heads of the screws into alignment with the wide ends 90 of the slots 70. Then the flange 40 may be moved axially away from the hub 36, releasing the grinding wheel 18.

The screws 50–64 (FIG. 3) are located so that they need not be removed completely to change the grinding wheel 18. The screws 50–64 extend axially from the hub 36 at a radial location which is inward of the central passage 120 (FIG. 2) through the grinding wheel 18. The screws 50–64 are located sufficiently inward of the central passage 120 through the grinding wheel 18 that the head portions 92 of the screws clear the passage as the grinding wheel is moved axially onto or off of the hub 36.

To prevent the grinding wheel 18 from being crushed or cracked between the gripping faces 42 and 44 on the hub 36 and flange 40, the hub and the flange have stop surfaces 140 and 142 which cooperate to limit the extent of axial motion of the flange 40 toward the hub 36. The stop surfaces 140 and 142 are axially offset from the gripping faces 42 and 44 on the hub 36 and flange 40. The total offset is such that when the two stop surfaces 140 and 142 are drawn into abutting engagement by tightening the screws 50–64, the distance between the two gripping faces 42 and 44 is equal to or only slightly less than the thickness of the grinding wheel 18.

The hub assembly 30 includes a cover 152 (FIGS. 2, 3 and 4) which is adapted to prevent dirt and grit from getting into the slots 70–84 in the flange 40. The cover 150 is an annular plate mounted on the flange 40 and extends across the outside of the slots 70–84. There are a plurality of circular holes 170–184 in the cover 150. Each hole is aligned with the narrow end 96 of a slot 70–84 so that a tool may be inserted through the cover 150 to loosen or tighten the screws 50–64. As shown in FIG. 5, the cover plate may be integrally formed with the flange 40.

Having described one specific preferred embodiment of the invention, the following is claimed:

1. A hub assembly for rotatably mounting a grinding wheel having a central passage extending between opposite major side surfaces of the grinding wheel, said assembly comprising a hub having first surface means for engaging a first major side surface of the grinding wheel and second surface means for engaging the central passage through the grinding wheel to position the grinding wheel relative to said hub, a generally annular flange having third surface means for engaging a second major side surface of the grinding wheel and fourth surface means for engaging the central passage through the grinding wheel to position said flange relative to the grinding wheel, and a plurality of screw means for drawing said flange toward said hub, each of said screw means being axially movable upon rotation thereof and each of said screw means having a head portion with a relatively large cross sectional area and a shank portion with a relatively small cross sectional area, said flange having surface means defining a plurality of slots, each of said slots having a relatively wide portion through which a head portion of one of said screw means is axially movable and shoulder means defining a relatively narrow portion for engaging a head portion of one of said screw means to limit axial motion of said flange relative to said screw means in a direction away from said hub, said flange being rotatable with respect to said hub between a first position in which said head portion of each of said screw means is aligned with one of said relatively wide portions of said slots to enable said flange to move axially away from said hub to release said grinding wheel and a second position in which said head portion of each of said screw means is aligned with one of said shoulder means of said slots to limit axial movement of said flange relative to said hub.

2. An assembly as set forth in claim 1 wherein each of said screw means is rotatable with respect to said hub and said flange when said flange is in said second position to thereby apply a force to the grinding wheel to hold the grinding wheel against movement relative to said flange and said hub.

3. An assembly as set forth in claim 1 wherein said slots extend through said flange, said flange including side surface means defining a side of said flange opposite said third surface means, said assembly further including a cover plate connected with said flange and disposed in abutting engagement with said side surface means to at least partially block one side of said slots.

4. An assembly as set forth in claim 3 wherein said cover plate is integrally formed with said flange.

5. An assembly as set forth in claims 3 or 4 wherein said cover plate includes surface means for defining a plurality of passages, each of said passages being aligned with a head portion of one of said plurality of screw means when said flange is in said second position to thereby provide access to each of said plurality of screw means.

6. An assembly as set forth in claim 1 wherein said hub includes first stop surface means for defining a stop surface extending transverse to an axis of the grinding wheel, said flange including second stop surface means for defining a stop surface extending parallel to said first stop surface means, said first stop surface means on said hub being axially offset from said first surface means on said hub, said second stop surface means on said flange being offset from said third surface means on said flange, said first and second stop surface means cooperating to limit the extent of axial motion of said flange toward said hub, said first and second stop surface means being disposed in abutting engagement when said first surface means on said hub and said third surface means on said flange are in engagement with opposite major side surfaces of the grinding wheel.

7. An assembly as set forth in claim 1 wherein the radially outer most part of the head portion of each of said plurality of screw means is located radially inward of said fourth surface means.

8. A hub assembly for rotatably mounting a grinding wheel having a pair of major side surfaces, said assembly comprising a hub having first surface means for engaging a first major side surface of the grinding wheel, a clamp member having second surface means for engaging a second major side surface of the grinding wheel, said clamp member including first surface means for defining a plurality of spaced apart openings which extend through said clamp member, said first surface means which defines said plurality of openings in said clamp member including means for defining a shoulder surface disposed within each of said openings between opposite side surfaces of said clamp member, said shoulder surface in each of said openings in said clamp member being disposed along a longitudinally extending side of the opening, a cover connected with a side of said clamp member opposite from said second surface means and extending across at least a portion of each of said openings in said clamp member, and a plurality of connector means for interconnecting said hub and clamp member, each of said connector means having a first end portion disposed in one of said openings in said clamp member and a second end portion disposed in engagement with said hub, said cover including second surface means defining a plurality of openings disposed in at least partial alignment with said openings in said clamp member to provide access to said plurality of connector means, each of said openings in said clamp member having an oblong configuration in a plane extending parallel to said second surface means, said plurality of connector means and said clamp member being relatively movable between an engaged condition in which said connector means are effective to hold said clamp member in engagement with the grinding wheel and a disengaged condition in which said connector means are ineffective to hold said clamp member in engagement with the grinding wheel, said first end portion of each of said plurality of connector means being disposed in abutting engagement with one of said shoulder surfaces when said plurality of connector means and said clamp member are in the engaged condition, said first end portions of said plurality of connector means being spaced from said shoulder surfaces when said plurality of connector means and said clamp member are in the disengaged condition.

9. An assembly as set forth in claim 8 wherein said cover member is integrally formed with said clamp member.

10. An assembly as set forth in claim 8 wherein said first end portion of each of said plurality of connector means includes a head portion with a relatively large cross sectional area and a shank portion with a relatively small cross sectional area, each of said openings in said clamp member having a wide portion through which a head portion of one of said connector means is axially movable and a narrow portion through which axial movement of a head portion of one of said connector means is blocked, said head portion of each of said plurality of connector means being aligned with the narrow portion of an opening when said clamp member and connector means are in the engaged condition, said head portion of each of said plurality of connector means being aligned with the wide portion of an opening when said clamp member and connector means are in the disengaged condition.

11. An assembly as set forth in claim 8 wherein the grinding wheel has a central passage, said hub having third surface means for engaging the central passage in the grinding wheel to position the grinding wheel relative to said hub, said clamp member having fourth surface means for engaging the central passage in the grinding wheel to position said clamp member relative to the grinding wheel.

12. A hub assembly for rotatably mounting a grinding wheel having a pair of major side surfaces, said assembly comprising a hub having first surface means for engaging a first major side surface of the grinding wheel, a clamp member having second surface means for engaging a second major side surface of the grinding wheel, said clamp member including first surface means for defining a plurality of spaced apart openings which extend through said clamp member, said first surface means which defines said plurality of openings in said clamp member including means for defining a shoulder surface disposed within each of said openings between opposite side surfaces of said clamp member and surface means for defining a recess in each of said openings, said shoulder surface in each of said openings in said clamp member being disposed along a longitudinally extending side of the opening, said recesses being axially offset from said shoulder surfaces and extending from said shoulder surfaces toward one of the side surfaces of said clamp member, a cover connected with a side of said clamp member opposite from said second surface means and extending across at least a portion of each of said openings in said clamp member, and a plurality of connector means for interconnecting said hub and clamp member, each of said connector means having a first end portion disposed in one of said openings in said clamp member and a second end portion disposed in engagement with said hub, said cover including second surface means defining a plurality of openings disposed in at least partial alignment with said openings in said clamp member to provide access to said plurality of connector means, each of said openings in said clamp member having an oblong configuration in a plane extending parallel to said second surface means, said plurality of connector means and said clamp member being relatively movable between an engaged condition in which said connector means are effective to hold said clamp member in engagement with the grinding wheel and a disengaged condition in which said connector means are ineffective to hold said clamp member in engagement with the grinding wheel, said first end portion of each of said plurality of connector means being disposed in abutting engagement with one of said recesses when said plurality of connector means and said clamp member are in the engaged condition, said first end portions of said plurality of connector means being spaced from said recesses when said plurality of connector means and said clamp member are in the disengaged condition.

13. An assembly as set forth in claim 12 wherein said cover member is integrally formed with said clamp member.

14. An assembly as set forth in claim 12 wherein said first end portion of each of said plurality of connector means includes a head portion with a relatively large cross sectional area and a shank portion with a relatively small cross sectional area, each of said openings having a wide portion through which a head portion of one of said connector means is axially movable and a narrow portion through which axial movement of a head portion of one of said connector means is blocked, said head portion of each of said plurality of connector means being aligned with the narrow portion of an opening when said clamp member and connector means are in the engaged condition, said head portion of each of said plurality of connector means being aligned with the wide portion of an opening when said clamp member and connector means are in the disengaged condition.

15. An assembly as set forth in claim 12 wherein the grinding wheel has a central passage, said hub having third surface means for engaging the central passage in the grinding wheel to position the grinding wheel relative to said hub, said clamp member having fourth surface means for engaging the central passage in the grinding wheel to position said clamp member relative to the grinding wheel.

16. A hub assembly for rotatably mounting a grinding wheel having a pair of major side surfaces, said assembly comprising a hub having first surface means for engaging a first major side surface of the grinding wheel, a clamp member having second surface means for engaging a second major side surface of the grinding wheel, said clamp member including first surface means for defining a plurality of spaced apart openings which extend through said clamp member, a cover connected with a side of said clamp member opposite from said second surface means and extending across at least a portion of each of said openings in said clamp member, and a plurality of connector means for interconnecting said hub and clamp member, each of said connector means having a first end portion disposed in one of said openings in said clamp member and a second end portion disposed in engagement with said hub, said first end portion of each of said plurality of connector means including a head portion with a relatively large cross sectional area and a shank portion with a relatively small cross sectional area, each of said openings having a wide portion through which a head portion of one of said connector means is axially movable and a narrow portion through which axial movement of a head portion of one of said connector means is blocked, said cover including second surface means defining a plurality of openings disposed in at least partial alignment with said openings in said clamp member to provide access to said plurality of connector means, said plurality of connector means and said clamp member being relatively movable between an engaged condition in which said connector means are effective to hold said clamp member in engagement with the grinding wheel and a disengaged condition in which said connector means are ineffective to hold said clamp member in engagement with the grinding wheel, said head portion of each of said plurality of connector means being aligned with the narrow portion of an opening in said clamp member when said clamp member and connector means are in the engaged condition, said head portion of each of said plurality of connector means being aligned with the wide portion of an opening in said clamp member when said clamp member and connector means are in the disengaged condition.

17. An assembly as set forth in claim 16 wherein the grinding wheel has a central passage, said hub having third surface means for engaging the central passage in the grinding wheel to position the grinding wheel relative to said hub, said clamp member having fourth surface means for engaging the central passage in the grinding wheel to position said clamp member relative to the grinding wheel.

18. An assembly as set forth in claim 16 wherein said cover member is integrally formed with said clamp member.

19. A hub assembly for releasably mounting on a rotatable shaft a circular grinding wheel having a central passage extending between opposite major side surfaces of the grinding wheel, said assembly comprising a hub having radially extending first surface means for engaging a first major side surface of the grinding wheel and second surface means for engaging the central passage through the grinding wheel to maintain the grinding wheel coaxial with the shaft and said hub, a generally annular flange having radially extending third surface means for engaging a second major side surface of the grinding wheel and central axially extending fourth surface means for engaging the central passage through the grinding wheel, a plurality of screw means for drawing said flange toward said hub, each of said screw means having a head portion with a relatively large diameter and a shank portion with a relatively small diameter, said hub having first stop surface means for defining a stop surface extending transverse to the axis of the shaft, said flange including second stop surface means for defining a stop surface extending parallel to said first stop surface means, said first stop surface means on said hub being axially offset from said first surface means, said second stop surface means on said flange being offset from said third surface means, said first and second stop surface means cooperating to limit the extent of axial motion of said flange toward said hub, said first and second stop surfaces being disposed in abutting engagement when said first surface means on said hub and said second surface means on said flange are in engagement with opposite major side surfaces of the grinding wheel, said flange having surface means defining a plurality of slots, each of said slots having a relatively wide portion through which a head portion of one of said screw means is axially movable and shoulder means defining a relatively narrow portion for preventing axial motion of said flange relative to said screw means in a direction away from said hub, said flange being rotatable with respect to said hub between a first position in which each of said heads of said plurality of screw means is aligned with a corresponding one of said relatively wide portions of said slots to enable said flange to move axially away from said hub to release the grinding wheel and a second position in which the head portion of each of said screw means is aligned with a corresponding shoulder means in one of said slots to hold said flange against axial movement relative to said hub, each of said screw means being rotatable with respect to said hub and said flange when said flange is in said second position to thereby apply a force to the grinding wheel to hold the grinding wheel against movement relative to said flange and said hub, said flange including generally annular outside surface means for defining a side of said flange opposite said surface means, and cover means connected with said flange and overlaying said annular outside surface means, said cover means being disposed in abutting engagement with said outside surface means on said flange, said cover, means including surface means for defining a plurality of passages, the passages being aligned with a head portion of each of said plurality of screw means when said flange is in said second position to thereby provide access to each of said plurality of screw means.

* * * * *